US007457560B2

(12) United States Patent
Nakaya et al.

(10) Patent No.: US 7,457,560 B2
(45) Date of Patent: Nov. 25, 2008

(54) DEVELOPING DEVICE

(75) Inventors: Yukiko Nakaya, Konan (JP); Mitsuru Horinoe, Chita-gun (JP); Hiroki Mori, Nagoya (JP); Yuichi Matsushita, Nagoya (JP)

(73) Assignee: Brother Kogyo Kabushiki Kaisha, Nagoya-shi, Aichi-ken ( * ) Notice: Subject to any disclaimer, the term of this patent is extended or adjusted under 35 U.S.C. 154(b) by 217 days.

(21) Appl. No.: 11/528,664

(22) Filed: Sep. 28, 2006

(65) Prior Publication Data

US 2007/0071490 A1 Mar. 29, 2007

(30) Foreign Application Priority Data

Sep. 28, 2005 (JP) ..... 2005-282636

(51) Int. Cl.
*G03G 15/08* (2006.01)

(52) U.S. Cl. ..... 399/103; 399/106; 399/111; 399/119

(58) Field of Classification Search ..... 399/91, 399/98, 102, 103, 105, 106, 111, 119, 120
See application file for complete search history.

(56) References Cited

U.S. PATENT DOCUMENTS 6,336,014 B1 1/2002 Sato et al.
6,459,867 B2 * 10/2002 Ohgoshi et al. ..... 399/103
6,496,668 B2 * 12/2002 Sato et al. ..... 399/103
7,076,185 B2 * 7/2006 Okamoto ..... 399/103
7,206,535 B2 * 4/2007 Nozawa ..... 399/103
7,292,802 B2 * 11/2007 Fukuta et al. ..... 399/103
7,336,913 B2 * 2/2008 Sato et al. ..... 399/103

FOREIGN PATENT DOCUMENTS

| | | |
|---|---|---|
| JP | 62-192769 | 8/1987 |
| JP | 62-208073 | 9/1987 |
| JP | 63-180984 | 7/1988 |
| JP | 9-80906 | 3/1997 |
| JP | 2000-338777 A | 12/2000 |
| JP | 2003-195628 A | 7/2003 |
| JP | 2003-270945 A | 9/2003 |

OTHER PUBLICATIONS

JP Office Action dtd Jun. 17, 2008, JP Appln. 2005-282636.

* cited by examiner

*Primary Examiner*—Hoan H Tran
(74) *Attorney, Agent, or Firm*—Banner & Witcoff, Ltd.

(57) ABSTRACT

A developing device is provided with a case main body, a developing roller coupled with the case main body, an axis direction seal member coupled with the case main body, and a side seal member coupled with the case main body. The axis direction seal member and the side seal member make contact with one another such that there is no gap between the axis direction seal member and the side seal member in a rotation axis direction of the developing roller. In a rotation direction of the developing roller, an upstream end of the side seal member is located downstream of an upstream end of a contact area between the axis direction seal member and the developing roller.

15 Claims, 6 Drawing Sheets

DEVELOPING DEVICE

CROSS-REFERENCE TO RELATED APPLICATION

This application claims priority to Japanese Parent Application No. 2005-282636, filed on Sep. 28, 2005, the contents of which are hereby incorporated by reference into the present application.

BACKGROUND OF THE INVENTION

1. Field of the Invention

The present invention relates to a developing device that houses developer such as toner. In addition, the present invention relates to a process cartridge and an image forming device.

2. Description of the Related Art

A laser printer, for example, uses a developer to print on a recording medium (e.g., printing paper). The laser printer has a developing device. The developing device has a case main body in which an opening is formed. A developing roller is coupled with the case main body at a position that faces the opening. The developing roller is capable of rotating and supporting the developer that is housed in the case main body. The laser printer has a photoreceptor that makes contact with the developing roller. An electrostatic latent image is formed on the surface of the photoreceptor. By rotating both the developing roller and the photoreceptor while in contact with each other, the developer supported by the developing roller adheres to the electrostatic latent image on the photoreceptor In this way, the electrostatic latent image on the photoreceptor becomes visible. By transferring the developer from the photoreceptor to the recording medium, text or image is printed on the recording medium.

If the developer housed in the developing device leaks to the exterior, devices disposed at the exterior of the developing device becomes soiled. It is necessary to form a developing device from which developer cannot leak. In the technology disclosed in U.S. Pat. No. 6,336,014, an axis direction seal member is installed on the case main body. The axis direction seal member extends along the rotation axis direction of the developing roller. By placing the axis direction seal member in contact with the developing roller, the axis direction seal member creates a seal between the case main body and the developing roller. In addition, in the technology of U.S. Pat. No. 6,336,014, a side seal member is used. The side seal member makes contact with the developing roller so that developer does not leak from the end of the developing roller in the rotation axis direction. In this way, a seal is formed between the end of the developing roller in the rotation axis direction and the case main body. The axis direction seal member and the side seal member make contact with one another. In this configuration, a gap is not formed between the axis direction seal member and the side seal member, and thus developer can be prevented from leaking out from between the axis direction seal member and the side seal member Note that in the above conventional technology, in the rotation direction of the developing roller, the upstream end of the side seal member is located upstream of a contact area between the axis direction seal member and the developing roller. In other words, the side seal member makes contact with the axis direction seal member at a position which is upstream of the contact area between the axis direction seal member and the developing roller.

BRIEF SUMMARY OF THE INVENTION

If developer enters between the side seal member and the case main body, this developer may leak from the case main body. Because of this, it is preferred that developer is prevented from entering between the side seal member and the case main body.

In this specification, a developing device which can prevent developer from leaking out is disclosed. This developing device comprises a case main body, a developing roller, an axis direction seal member, and a side seal member. In a rotation direction of the developing roller, an upstream end of the side seal member is located downstream of an upstream end of a contact area between the axis direction seal member and the developing roller.

EMBODIMENT

Figure 1:
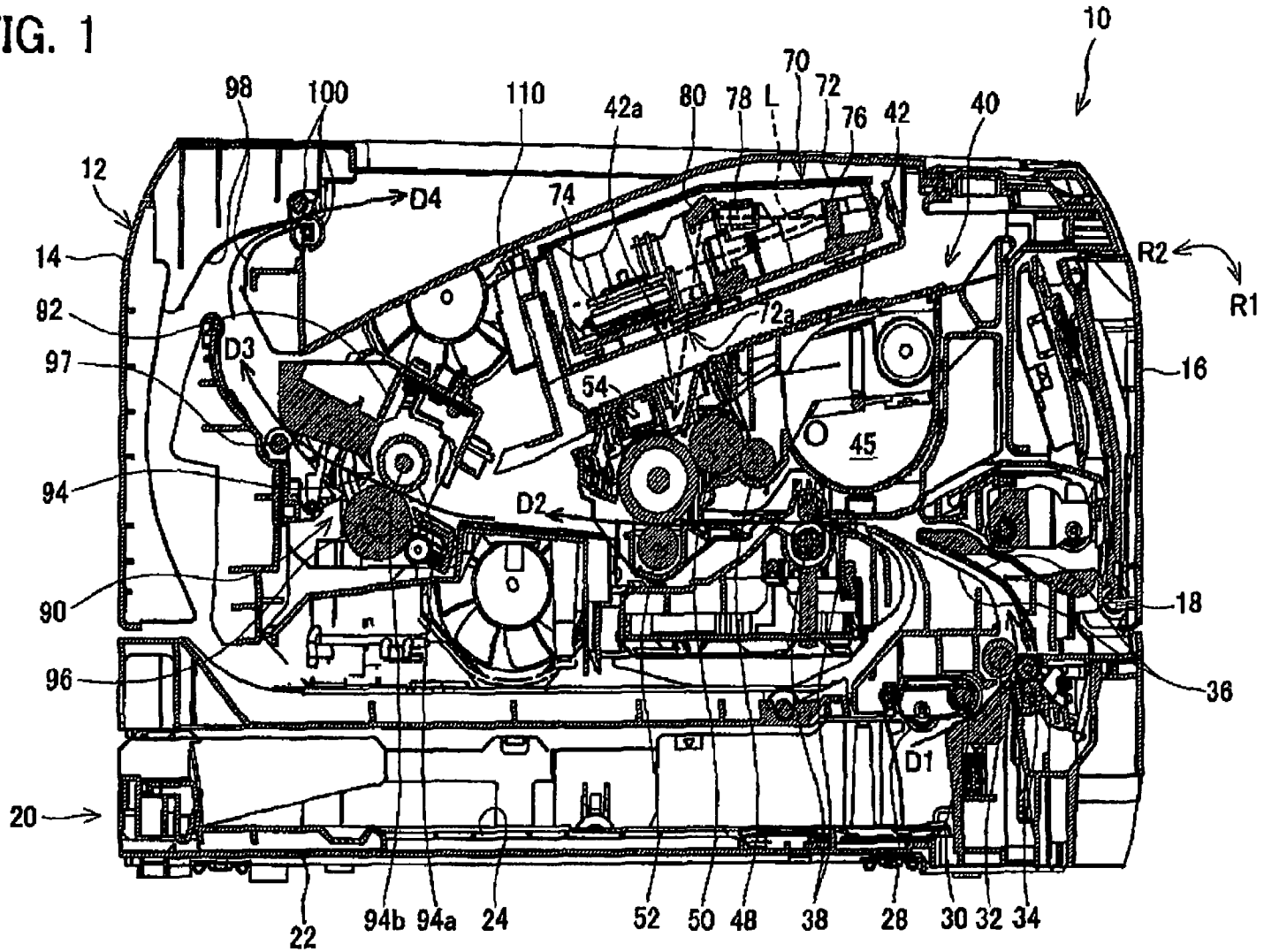
FIG. 1 shows a cross-sectional view of a laser printer of the present embodiment.

An embodiment of the present invention will be described with reference to the drawings. FIG. 1 is a cross-sectional view of a laser printer 10 of the present embodiment. The laser printer 10 will be hereinafter referred to as printer 10. In the present embodiment, the right side of FIG. 1 is the front of the printer 10.

The printer 10 has a casing 12. The casing 12 is constructed by means of a plurality of plate-shaped members. FIG. 1 shows a rear side cover member 14, a front side cover member 16, and the like as members that constitute the casing 12. The front side cover member 16 can pivot in the direction of the arrow R1 or the arrow R2 with an axis 18 at the center. The casing 12 will open when the front side cover member 16 pivots in the direction of the arrow R1. A process cartridge 40 (described below) can be exchanged in this state. The casing 12 will close when the front side cover member 16 pivots in the direction of the arrow R2.

The printer 10 has a paper supply device 20, the process cartridge 40, an exposure device 70, a toner fixing device 90, and the like. Each of the devices 20, 40, 70, 90 is disposed in the interior of the casing 12. Each device 20, 40, 70 and 90 will be described in sequence below.

The paper supply device 20 comprises a paper supply tray 22, four rollers 28, 30, 32, 34, and the like. Paper for printing (not shown in the drawings) will be stacked in the paper supply tray 22. The paper supply tray 22 has a bottom plate 24 on which the stacked printing paper will be placed. The uppermost sheet of the printing paper placed on the bottom plate 24 will be in contact with the paper supply roller 28. When the paper supply tray 22 is housed inside the casing 12, the front end of the bottom plate 24 (the end on the right side of FIG. 1) will be urged upward by a mechanism not shown in the drawings. Thus, when the number of sheets of printing paper is reduced, the front end of the bottom plate 24 will be raised upward. Because of this construction, the uppermost sheet of the printing paper can always be placed in contact with the paper supply roller 28.

The paper supply roller 28 is connected to a drive source not shown in the drawings. The paper supply roller 28 can be rotated counterclockwise. The uppermost sheet of printing paper stored in the paper supply tray 22 will be transported to the right (arrow D1) when the paper supply roller 28 rotates. The printing paper transported to the right will come into contact with the separation roller 30. The separation roller 30 is not connected to a power source. The separation roller 30 is driven counterclockwise by coming into contact with the printing paper. When a plurality of sheets of printing paper has been transported, the separation roller 30 will separate the printing paper so that only one sheet thereof will be transported downstream. The printing paper that passes the separation roller 30 will then be transported between the pinch roller 32 and the paper dust removal roller 34.

The pinch roller 32 and the paper dust removal roller 34 are not connected to a drive source. The pinch roller 32 is urged toward the paper dust removal roller 34 by an urging means not shown in the drawings. The printing paper between the pinch roller 32 and the paper dust removal roller 34 will be pressed onto the paper dust removal roller 34 by the pinch roller 32. The surface of the paper dust removal roller 34 has been specially treated, and can remove paper dust from the printing paper that it is in contact with. The printing paper will be transported between two resist rollers 38, 38 along a rail 36.

The lower resist roller 38 is connected to a drive source not shown in the drawings. The printing paper can be transported in the direction of arrow D2 by rotating the lower resist roller 38 counterclockwise. The upper resist roller 38 rotates in the clockwise direction by following the rotation of the lower resist roller 38.

Text or images is printed on the printing paper when the printing paper is transported in the direction of the arrow D2 by the resist roller 38. More specifically, printing will be performed by means of the process cartridge 40, the exposure device 70, and the fixing device 90.

The process cartridge 40 is detachably mounted on the casing 12. The process cartridge 40 can be removed from the casing 12 when the front cover 16 is opened (arrow R1). An old process cartridge 40 can be replaced with new one.

Details of the structure of the process cartridge 40 will be described below. The basic structure of the process cartridge 40 will be described here. The process cartridge 40 has a casing 42. A through hole 42*a* is formed in the upper surface of the casing 42. A toner chamber 45 is formed on the right side of the interior of the casing 42. Toner is housed in the toner chamber 45. Three rollers 48, 50, 52 and a photoreceptor drum 54 are disposed on the left side of the interior of the casing 42. The rollers 48, 50, 52 and the drum 54 are respectively connected to a drive source not shown in the drawings. The roller 48 positioned furthest to the right will be referred to as the supply roller. The developing roller 50 is disposed on the left side of the supply roller 48. The photoreceptor drum 54 is disposed on the left side of the developing roller 50. The transfer roller 52 is disposed below the photoreceptor drum 54. Printing paper that has been transported in the direction of the arrow D2 by the resist roller 38 will enter between the photoreceptor drum 54 and the transfer roller 52. The transfer roller 52 will rotate in the counterclockwise direction when the photoreceptor drum 54 rotates in the clockwise direction. The printing paper will be transported further leftward (arrow D2) by rotating the photoreceptor drum 54 and the transfer roller 52. Toner attached to the photoreceptor drum 54 will be transferred to the printing paper as it is transported leftward.

The exposure device 70 is disposed above the process cartridge 40. The exposure device 70 is fixed to the casing 12. The exposure device 70 has a casing 72. A through hole 72*a* is formed in the lower surface of the casing 72. A polygon mirror 74, a reflector 76, a lens 78, a reflector 80, and the like are provided inside the casing 72. The exposure device 70 has a light source that is not shown in the drawings. A laser beam will be generated from the light source based upon the content of the print data. The laser beam supplied from the light source will be deflected by the polygon mirror 74 toward the reflector 76. The laser beam will reflect off the reflector 76 and pass through the lens 78. The laser beam that has passed through the lens 78 will be further reflected by the reflector 80. The laser beam reflected by the reflector 80 will exit the casing 72 from the through hole 72*a* and project downward.

The laser beam that has exited the casing 72 will pass through the through hole 42*a* of the casing 42 of the process cartridge 40 and arrive at the photoreceptor drum 54. In this way, the photoreceptor drum 54 will be exposed with a prescribed pattern. The path of the laser beam described above is shown with the arrow L in FIG. 1.

Next, the structure of the toner fixing device 90 will be described. The toner fixing device 90 is disposed to the rear of the process cartridge 40 (the left side of FIG. 1). The toner fixing device 90 comprises a frame 92, a heating roller 94, and a pressure roller 96. The frame 92 supports the heating roller 94 and the pressure roller 96 in a manner allowing rotation.

The heating roller 94 has a metal pipe 94*a*, and a halogen lamp 94*b* that is disposed in the interior thereof. The halogen lamp 94*b* will heat the metal pipe 94*a*. The heating roller 94 is connected to a drive source not shown in the drawings. When the drive source is operated, the heating roller 94 will rotate in the clockwise direction. The pressure roller 96 is urged toward the heating roller 94 by means of a mechanism not shown in the drawings. The pressure roller 96 is not connected to a drive source. The pressure roller 96 will be driven in the counterclockwise direction when the heating roller 94 is rotated in the clockwise direction.

The printing paper that has passed through the process cartridge 40 will be inserted between the heating roller 94 and the pressure roller 96. When the heating roller 94 rotates in the clockwise direction, the printing paper between the heating roller 94 and the pressure roller 96 will be transported leftward. The printing paper will be heated by means of the heating roller 94 that has been heated to a high temperature. In this way, the toner transferred to the printing paper will be fixed thereto by means of heat. The printing paper that has passed through the toner fixing device 90 will be transported upward and to the left (arrow D3).

A transport roller 97 is disposed immediately below the left end of the frame 92. The transport roller 97 is supported by the casing 12. The transport roller 97 is connected to a drive source not shown in the drawings. The transport roller 97 will rotate in the counterclockwise direction. The transport roller 97 will transport the printing paper transported from the toner fixing device 90 further upward and to the left. The printing paper transported upward and to the left by the transport roller 97 will be transported rightward along a rail 98.

Two discharge rollers 100, 100 are disposed on the right side of the rail 98. The lower discharge roller 100 is connected to a drive source not shown in the drawings. The lower discharge roller 100 will rotate in the clockwise direction. The upper discharge roller 100 is not connected to a power source. When the lower discharge roller 100 rotates in the clockwise direction, the upper discharge roller 100 rotates in the counterclockwise direction.

The printing paper transported by the transport roller 97 is inserted between the two discharge rollers 100, 100. When the lower discharge roller 100 rotates in the clockwise direction, the printing paper between the two discharge rollers 100, 100 is transported rightward. The printing paper is transported out of the casing 12. A discharge tray 110 is formed on the upper surface of the casing 12. The printing paper transported out of the casing 12 is discharged onto the discharge tray 110.

Figure 2:
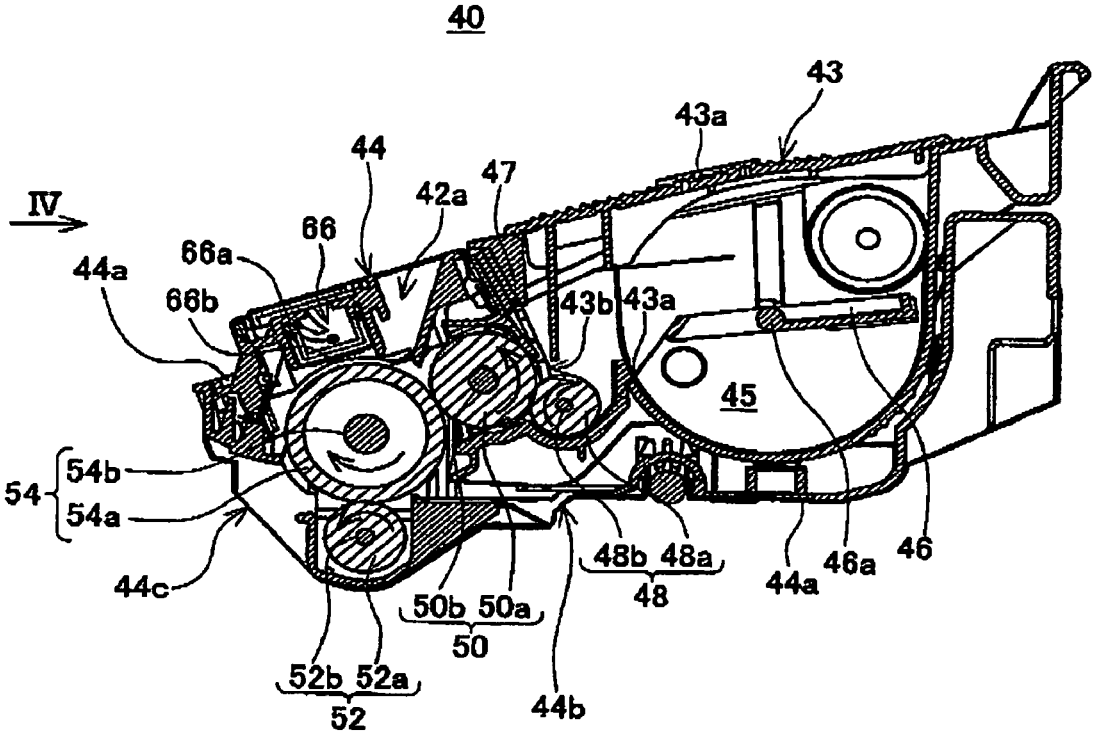
FIG. 2 shows an expanded cross-sectional view of a process cartridge.

The basic structure of the printer 10 has been described. How the printing paper is transported inside the casing 12 has been described. Next, the detailed structure of the process cartridge 40 will be described with reference to FIG. 2. FIG. 2 shows an enlarged cross-section of the process cartridge 40.

Figure 3:
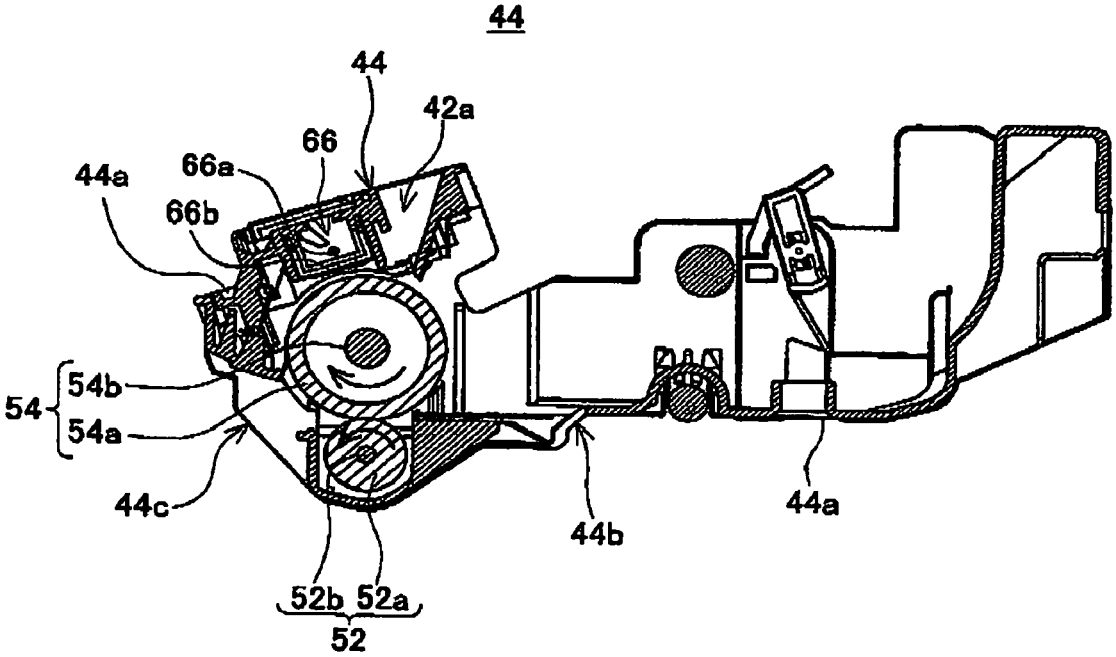
FIG. 3 shows a cross-sectional view of a photoreceptor cartridge.

The process cartridge 40 is constructed by two cartridges 43, 44. The cartridge 43 disposed on the right side will be referred to as a developer cartridge, and the cartridge 44 disposed on the left side will be referred to as a photoreceptor cartridge. The developer cartridge 43 and the photoreceptor cartridge 44 are connected in a manner allowing separation. FIG. 3 shows a cross-section of the photoreceptor cartridge 44 after the developer cartridge 43 was separated. This process cartridge 40 allows only the developer cartridge 43 to be exchanged, and also allows only the photoreceptor cartridge 44 to be exchanged. The entire process cartridge 40 can also be exchanged.

The structure of the two cartridges 43, 44 will be described below. First, the structure of the photoreceptor cartridge 44 will be described. The photoreceptor cartridge 44 has a casing 44*a*. The through hole 42*a* through which a laser beam will pass is formed in the upper surface of the casing 44*a*. An entrance hole 44*b* through which printing paper will enter is formed in the lower surface of the casing 44*a*. In addition, an exit hole 44*c* through which printing paper will exit is formed in the left side surface of the casing 44*a*. The printing paper enters into the photoreceptor cartridge 44 from the entrance hole 44*b*, passes between the photoreceptor drum 54 and the transfer roller 52, and exits from the exit hole 44*c*.

The photoreceptor drum 54, the transfer roller 52, and a charger 66 are disposed inside the casing 44*a* of the photoreceptor cartridge 44.

The photoreceptor drum 54 is in contact with the developing roller 50 on the left side of the developing roller 50. The photoreceptor 54 has a photoreceptor drum main body 54*a* and a photoreceptor drum shaft 54*b*. The photoreceptor drum main body 54*a* has a tubular shape. The photoreceptor drum main body 54*a* is a positive charge type photoreceptor. The surface of the photoreceptor drum main body 54*a* is constructed by polycarbonate or the like. The photoreceptor drum shaft 54*b* is made of metal. The photoreceptor drum shaft 54*b* is fixed to the casing 44*a* of the photoreceptor cartridge 44. The photoreceptor drum main body 54*a* is attached to the photoreceptor drum shaft 54*b*. The photoreceptor drum main body 54*a* is connected to a drive source not shown in the drawings. The photoreceptor drum main body 54*a* rotates in the clockwise direction.

The transfer roller 52 is in contact with the photoreceptor drum 54 on the lower side of the photoreceptor drum 54. The transfer roller 52 comprises a transfer roller main body 52*a* and a transfer roller shaft 52*b*. The transfer roller main body 52*a* is made of a conductive rubber material. The transfer roller shaft 52*b* is made of metal. The transfer roller shaft 52*b* is attached to the casing 44*a* of the photoreceptor cartridge 44. The transfer roller shaft 52*b* is connected to a drive source not shown in the drawings. The transfer roller 52 rotates in the counterclockwise direction. The transfer roller shaft 52*b* is connected to a voltage supply circuit not shown in the drawings. During transfer (during the time in which the toner adhered to the photoreceptor drum 54 is transferred to printing paper), a bias voltage will be applied from the voltage supply circuit to the transfer roller 52.

The charger 66 is disposed above the photoreceptor drum 54. A gap is arranged between the charger 66 and the photoreceptor drum 54. The charger 66 is a scorotron type. The charger 66 has a discharge wire 66*a* and a grid 66*b*. The discharge wire 66*a* is a wire that extends perpendicular to the plane of FIG. 2. A high voltage will be applied to the discharge wire 66*a*. The grid 66*b* is disposed between the discharge wire 66*a* and the photoreceptor drum 54. A bias voltage will be applied to the grid 66*b*. In this way, the amount of electric discharge of the discharge wire 66*a* is regulated. A high voltage is applied to the discharge wire 66*a* and a corona discharge will occur, and a bias voltage is applied to the grid 66*b*. In this way, the surface of the photoreceptor drum 54 (the photoreceptor drum main body 54*a*) is provided with a positive electrostatic charge.

Next, the structure of the developer cartridge 43 will be described. The developer cartridge 43 has a case main body 43*a*. The toner chamber 45 is formed inside the case main body 43*a*. Toner is housed in the toner chamber 45. In the present embodiment, a positive electrostatic charge type, non-magnetic mono-component toner is used. For example, a polymer toner obtained by co-polymerizing a styrene monomer and an acrylic monomer by means of suspension polymerization will be used. Examples of acryl monomers that can be used include acrylic acid, alkyl (C1-C4) acrylate, alkyl (c1-C4) methacrylate, and the like. The polymer toner is substantially spherical in shape, and has excellent fluidity. A colorant and a wax are combined with the polymer toner. In addition, in order to improve fluidity, an additive such as silica or the like is added.

An agitator 46 is disposed in the toner chamber 45. The agitator 46 is attached to the case main body 43*a*, and rotates with a shaft 46*a* as a center. When the agitator 46 rotates in the clockwise direction, the toner inside the toner chamber 45 is agitated. In this way, the toner is supplied to the supply roller 48.

An opening 43*b* is formed in the left surface of the case main body 43*a*. The opening 43*b* extends in a direction that is perpendicular to the plane of FIG. 2. The supply roller 48 is arranged on the right side of the opening 43*b*. The developing roller 50 is arranged on the left side of the opening 43*b*.

The supply roller 48 comprises a supply roller main body 48*a* and a supply roller shaft 48*b*. The supply roller main body 48*a* is formed by means of a conductive foam material. The supply roller shaft 48*b* is made of metal. The supply roller 48 is supported by the case main body 43*a* of the developer cartridge 43. The supply roller 48 is connected to a drive source not shown in the drawings. The supply roller 48 rotates in the clockwise direction.

The developing roller 50 is in contact with the supply roller 48 on the left side of the supply roller 48. The developing roller 50 comprises a developing roller main body 50*a* and a developing roller shaft 50*b*. The developing roller main body 50*a* is made of a conductive rubber material. Examples of the rubber material that can be used include a conductive urethane rubber or a silicone rubber that contains carbon microparticles or the like. The surface of the urethane rubber or the silicone rubber is coated with a urethane rubber or a silicone rubber containing fluorine. The developing roller shaft 50*b* is made of metal. The developing roller shaft 50*b* is connected to a voltage supply circuit not shown in the drawings. During development (during the time in which the toner is adhered to the photoreceptor drum 54 from the developing roller 50), a bias voltage is applied from the voltage supply circuit to the developing roller 50. The developing roller 50 is supported by the case main body 43*a* at a position that faces the opening 43*b*. The developing roller 50 is connected to a drive source not shown in the drawings. The developing roller 50 rotates in the counterclockwise direction.

An adjustment member 47 is fixed to the case main body 43*a*. The adjustment member 47 is arranged on the left side of the opening 43*b*. The adjustment member 47 extends in a direction that is perpendicular to the plane of FIG. 2, and is in contact with the developing roller 50. In this way, the thickness of the developer layer formed on the surface of the developing roller 50 is regulated (adjusted).

Figure 4:
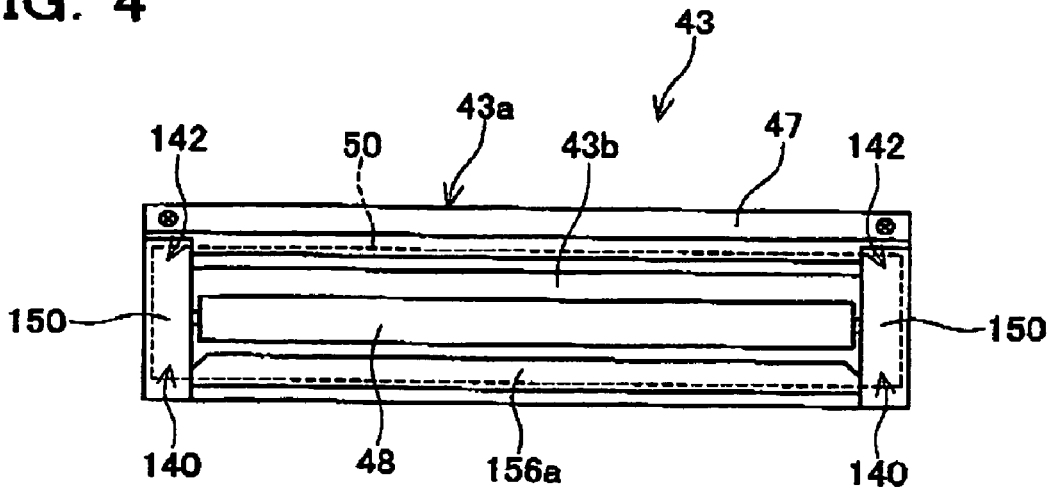
FIG. 4 shows a front view of a developer cartridge viewed from the IV direction of FIG. 2.

FIG. 4 shows a simplified view of the developer cartridge 43 when viewed in the direction of line IV of FIG. 2. The developing roller 50 is shown with a broken line in FIG. 4. The developing roller 50 extends in the horizontal direction at a position that faces the opening 43*b* of the case main body 43*a*. The adjustment member 47 is fixed to the upper portion of the case main body 43*a*. The adjustment member 47 extends in the horizontal direction (rotation axis direction of the developing roller 50).

There are areas 140, 140 that face the rotation surface of the developing roller 50 on both ends (right end and left end) of the case main body 43*a*. In addition, there are areas 142, 142 that face the rotation surface of the developing roller 50 on both ends (right end and left end) of the adjustment member 47. The right side facing area 140 of the case main body 43*a* and the right side facing area 142 of the adjustment member 47 are aligned in the vertical direction. Also, the left side facing area 140 and the left side facing area 142 are aligned in the vertical direction. In the rotation direction of the developing roller 50, the facing areas 140, 140 of the case main body 43*a* are located upstream of the facing areas 142, 142 of the adjustment member 47.

There are two side seal members 150, 150. One of the side seal members 150 is bonded to the right side facing area 140 and the right side facing area 142. The other of the side seal members 150 is bonded to the left side facing area 140 and the left side facing area 142.

Figure 5:
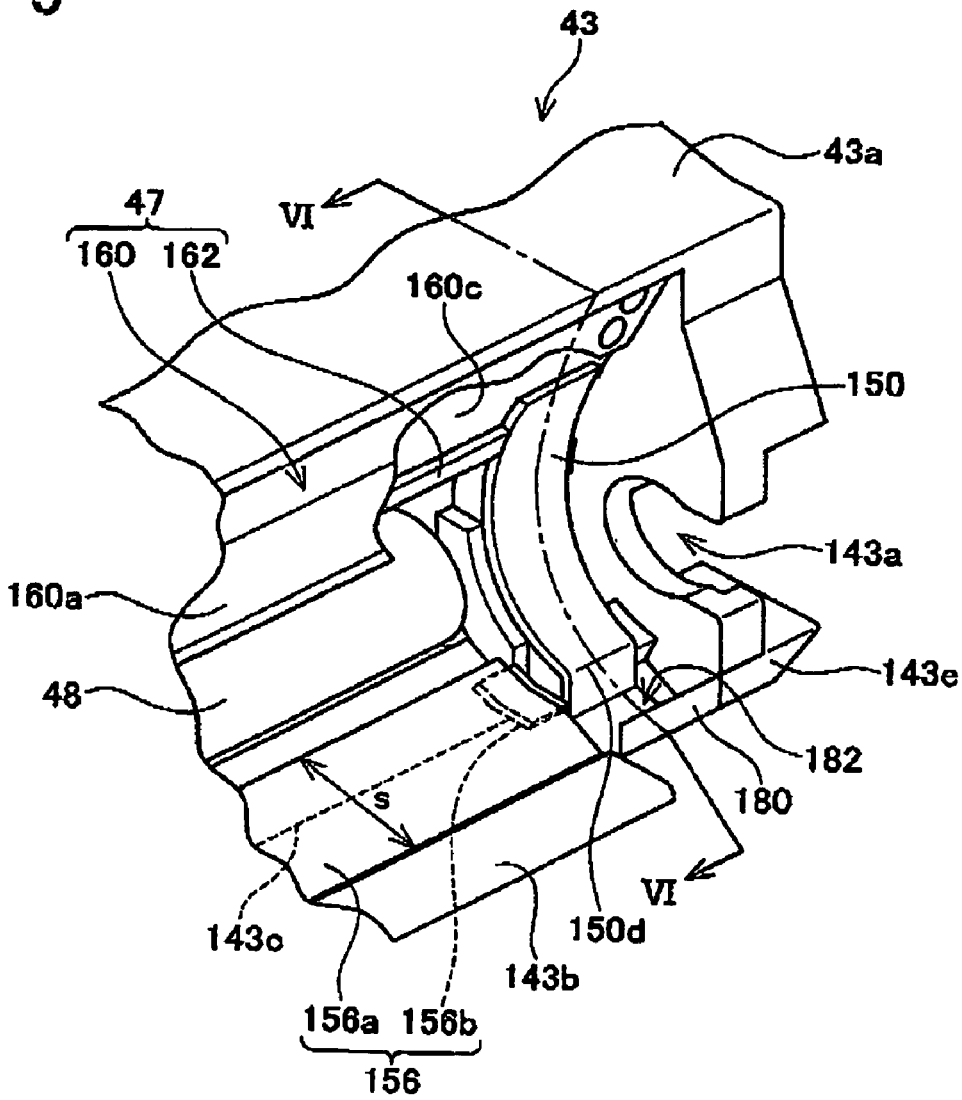
FIG. 5 shows a perspective view of an end part of the developer cartridge.

FIG. 5 shows a perspective view of the area around the right end of the developer cartridge 43 (the right end of FIG. 4). The structure of the right end of the developer cartridge 43 will be described in detail. A detailed description of the left end of the developer cartridge 43 will be omitted because it is a mirror image of the right end of the developer cartridge 43. Note that FIG. 5 shows a portion of a frame member 160*a* (described below) cut away, so that the structure of the adjustment member 47 will be clearly understood.

The developing roller 50 is not shown in FIG. 5. A hole 143*a* for supporting the developing roller 50 is provided in the right end of the case main body 43*a*. The developing roller shaft 50*b* (see FIG. 2) extends outward beyond the hole 143*a* (rightward in FIG. 5).

A front frame 143*b* is formed on the lower portion of the case main body 43*a*. An axis direction seal member 156 is mounted on the front frame 143*b*. The axis direction seal member 156 has an axis direction seal portion 156*a* and a rotation direction seal portion 156*b*. The axis direction seal portion 156*a* is a thin film, and is formed from polyethylene terepthalate (PET). The axis direction seal portion 156*a* extends along the rotation axis direction of the developing roller 50. The axis direction seal portion 156*a* extending along the rotation axis direction (the horizontal direction) can be clearly seen in FIG. 4. In addition, the axis direction seal portion 156*a* has a vertical width in a range shown with the arrow S in FIG. 5. A part of the front frame 143*b* beyond the reference number 143*c* bends downwards. That is, the front frame 143*b* curves downward. The axis direction seal portion 156*a* extends rearward beyond the portion 143*c* of the front frame 143. In other words, the axis direction seal portion 156*a* has a floating portion that is not adhered to the front frame 143*b*. The axis direction seal portion 156*a* and the front frame 143*b* are adhered together by means of two-sided tape.

The rotation direction seal portion 156*b* is short along the rotation axis direction of the developing roller 50, and long along the rotation direction of the developing roller 50. The rotation direction seal portion 156*b* is arranged between the outer end of the axis direction seal portion 156*a* (the right end in FIG. 5) and the front frame 143*b*. The rotation direction seal portion 156*b* is bonded to the front frame 143*b*. The rotation direction seal portion 156*b* is formed from felt. The rotation direction seal portion 156*b* projects outward (to the right in FIG. 5) past the axis direction seal portion 156*a*. The outer surface of the rotation direction seal portion 156*b* is in contact with the inner surface of the side seal member 150. In the present embodiment, the outer surface of the axis direction seal portion 156*a* is not in contact with the inner surface of the side seal member 150. A gap is arranged between the outer surface of the axis direction seal portion 156*a* and the inner surface of the side seal member 150.

The rotation surface of the developing roller 50 is in contact with the axis direction seal portion 156*a*. In addition, the rotation surface of the developing roller 50 is also in contact with the portion of the rotation direction seal portion 156*b* that projects out from the axis direction seal portion 156*a*. By placing the developing roller 50 in contact with the axis direction seal portion 156*a* and the rotation direction seal portion 156*b*, a seal is created between the lower portion of the developing roller 50 and the case main body 43*a*.

Figure 6:
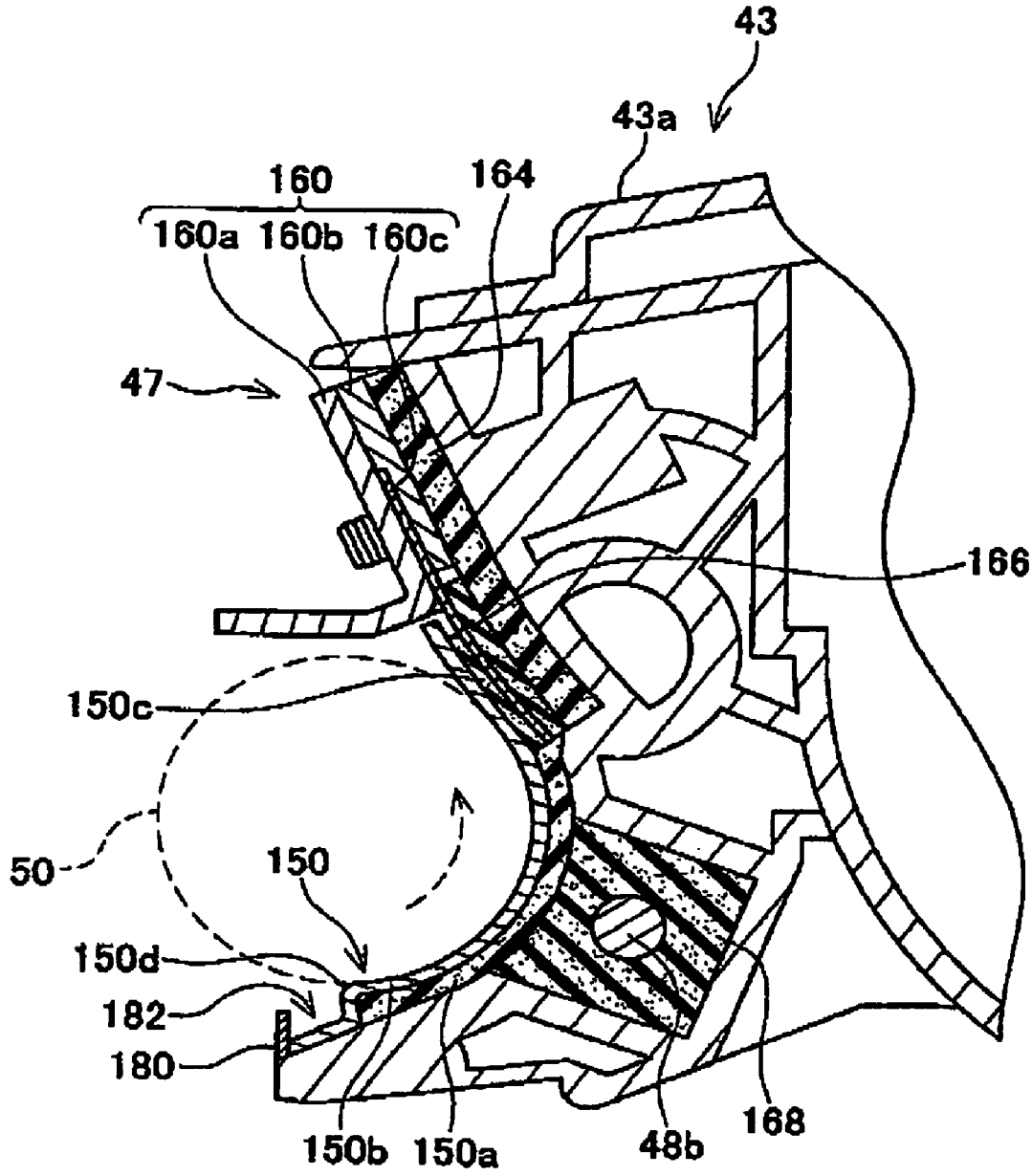
FIG. 6 shows a cross-sectional view along the line VI-VI of FIG. 5

Next, the structure of the side seal member 150 will be described in detail with reference to FIG. 6. FIG. 6 shows a cross-sectional view along line VI-VI of FIG. 5. Note that the developing roller 50 is shown with a broken line in FIG. 6. The arrow of the broken line indicates the rotation direction of the developing roller 50.

The side seal member 150 has a case side elastic member 150*a*, an adjustment member side elastic member 150*c* , and a felt member 150*b*. The case side elastic member 150*a* is bonded to the facing area 140 of the case main body 43*a* (see FIG. 4). The adjustment member side elastic member 150*c* is bonded to the facing area 142 of the adjustment member 47 (see FIG. 4). The felt member 150*c* is bonded to both the case side elastic member 150*a* and the adjustment member side elastic member 150*c*. The felt member 150*b* is in contact with the rotation surface of the developing roller 50. In this way, the end (right end of FIG. 4) of the developing roller 50 is sealed.

The felt member 150*b* extends leftwards (upstream side of the rotation direction of the developing roller 50) beyond the case side elastic member l50*a* The portion of the felt member 150*b* that extends leftwards beyond the case side elastic member 150*a* is bonded to the case main body 43*a*. The portion of the felt member 150*b* that is bonded to the case main body 43*a* is not in contact with the developing roller 50. The portion of the felt member 150*b* that is bonded to the case main body 43*a* does not function as a seal for the developing roller 50. The portion indicated with reference number 150*d* is the upstream end of the portion that functions as a seal for the side seal member 150. The position indicated with reference numeral 150*d* will be referred to below as the upstream end of the side seal member 150.

As shown in FIG. 5, the side seal member 150 is thicker than the axis direction seal member 156. The upper surface of the side seal member 150 (the surface on the developing roller 50 side) is in a position that is higher than the upper surface of the axis direction seal member 156.

Next, the structure of the adjustment member 47 will be described in detail. The adjustment member 47 has a support member 160. The support member 160 supports a contact member 162 that makes contact with the developing roller 50. The contact member 162 is not visible in the cross-sectional view of FIG. 6, but is shown in FIG. 5. The contact member 162 extends along the rotation axis direction of the developing roller 50, and is in contact with substantially the entire area of the developing roller 50 along the rotation axis direction thereof. The contact member 162 is made of rubber. The support member 160 is formed from two frame members 160*a*, 160*b* and a stainless steel plate 160*c*. The front side frame member 160*a* (the left side of FIG. 6) is substantially L-shaped. The stainless steel plate 160*c* is interposed between the front side frame member 160*a* and the rear side frame member 160*b*. The two frame members 160*a*, 160*b* and the stainless steel plate 160*c* respectively extend along the rotation axis direction of the developing roller 50 (in the direction perpendicular to the plane of FIG. 6). As shown in FIG. 5, the contact member 162 is bonded to the stainless steel plate 160*c*. The contact member 162 is not bonded to the ends (right end and left end of FIG. 4) of the stainless steel plate 160*c*. The adjustment member side elastic member 150*c* is bonded to this end.

A sponge member 164 is disposed between the case main body 43*a* and the rear side frame member 160*b*. The sponge member 164 extends along the rotation axis direction of the developing roller 50. The sponge member 164 creates a seal between the case main body 43*a* and the frame member 160*b*. A sponge member 166 is also disposed between the sponge member 164 and the stainless steel plate 160*c*. The sponge member 166 also extends along the rotation axis direction of the developing roller 50, and functions as a seal.

An elastic member (e.g., a sponge) 168 that is embedded around the supply roller shaft 48*b* is disposed on the lower portion of the case main body 43*a*. The side seal member 150 (the case side elastic member 150*a*) is also bonded to the sponge 168.

As shown in FIG. 5, a guard film 180 is arranged outward of the axis direction seal member 156 (the right side of FIG. 5). The guard film 180 is attached to the front surface 143*e* of the case main body 43*a*. The guard film 180 extends from the front surface 143*e* of the case main body 43*a* to the front frame 143*b*. A space 182 is provided between the guard film 180 and the side seal member 150. The formation of the space 182 is also clearly seen in FIG. 6. The space 182 functions as a toner receiver. How the toner receiver 182 functions will be described in detail below.

Figure 7:
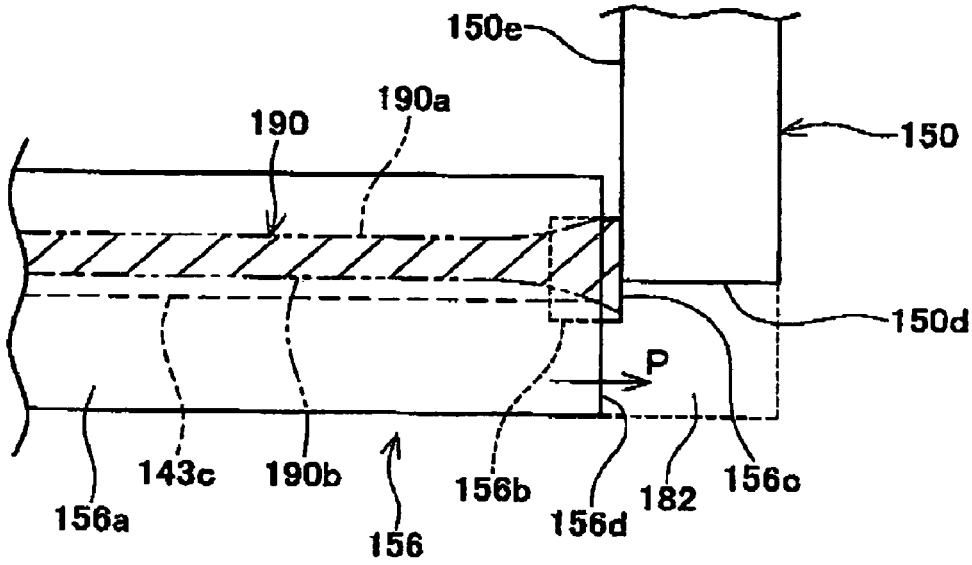
FIG. 7 shows a simplified front view of a side seal member and an axis direction seal member.

Next, the positional relationship between the axis direction seal member 156 and the side seal member 150 will be described in detail with reference to FIG. 7. FIG. 7 shows a simplified front view of the axis direction seal member 156 and the side seal member 150.

An area 190 shown by hatching indicates the portion in which the axis direction seal member 156 is in contact with the developing roller 50. An imaginary line 190*b* indicates the upstream end of the contact area 190 (the upstream end in the rotation direction of the developing roller 50). An imaginary line 190*a* indicates the downstream end of the contact area 190 (the downstream end in the rotation direction of the developing roller 50). The rotation direction seal portion 156*b* projects outward (to the right in FIG. 7) more than the axis direction seal portion 156*a*. The rotation direction seal portion 156*b* is in contact with the developing roller 50 at the projecting portion.

The central portion of the contact area 190 in the horizontal direction is shallower than the end portions of the contact area 190. That is, the upstream end 190*b* of the contact area 190 extends in a straight line along the rotation axis direction in the central portion of the developing roller 50, and the outer ends thereof are curved on the upstream side (the lower side of FIG. 7). In addition, the downstream end 190*a* of the contact area 190 extends in a straight line along the rotation axis direction in the central portion of the developing roller 50, and the outer ends thereof are curved on the downstream side (the upper side of FIG. 7). The central portion of the upstream end 190*b* of the contact area 190 (the portion that extends in a straight line) is located downstream of the downstream end 143*c* of a bonding area between the front frame 143*b* (see FIG. 5) and the axis direction seal portion 156*a*. In the present embodiment, the upstream end 150*d* of the side seal member 150 is located between the upstream end 190*b* of the contract area 190 and the downstream end of the axis direction seal member 156 (the axis direction seal portion 156*a*). More specifically, the upstream end 150*d* of the side seal member 150 is located between the upstream end 190*b* and the downstream end 190*a* of the contract area 190. The upstream end 150*d* of the side seal member 150 is located downstream (the upper side of FIG. 7) of the central portion (the portion that extends in a straight line) of the upstream end 190*b* of the contact area 190. The side seal member 150 is not disposed upstream of the contact area 190.

The outer surface 156*c* of the rotation direction seal portion 156*b* is in contact with the inner surface 150*e* of the side seal member 150. A gap is arranged between the outer surface 156*d* of the axis direction seal portion 156*a* and the inner surface 150*e* of the side seal member 150.

The structure of the process cartridge 40 has been described in detail. Referring again to FIG. 2, the operation of the process cartridge 40 having the aforementioned structure will be described.

The toner of the toner chamber 45 adheres to the supply roller 48. The toner adhered to the supply roller 48 is positively charged by means of friction between the supply roller 48 and the developing roller 50. The toner that is positively charged covers the surface of the developing roller SO. The contact member 162 of the adjustment member 47 (see FIG. 5) makes contact with the toner layer on the surface of the developing roller 50. In this way, the toner layer is adjusted to a uniform thickness.

In contrast, the surface of the photoreceptor drum main body 54*a* is positively charged by means of the charger 66. The surface of the positively charged photoreceptor drum main body 54*a* is irradiated with a laser beam generated from the exposure device 70 (see FIG. 1). In this way, a predetermined portion of the surface of the photoreceptor drum main body 54*a* is thus exposed. The electric potential of the exposed portion of the photoreceptor drum main body 54*a* is reduced. The part that is exposed varies based on the content to be printed. An electrostatic latent image based upon the print content is formed on the photoreceptor drum main body 54*a*.

The toner that covers the developing roller 50 adheres to the exposed portion of the photoreceptor drum main body 54*a*. At this point, the toner does not adhere to the non-exposed portion of the photoreceptor drum main body 54*a*. In this way, the electrostatic latent image formed on the photoreceptor drum main body 54*a* becomes visible. A visible image having a uniform thickness is developed on the photoreceptor drum main body 54*a* because the thickness of the toner layer on the developing roller 50 is uniformly maintained by means of the adjustment member 47.

The visible image supported on the photoreceptor drum main body 54*a* is transferred to printing paper between the photoreceptor drum 54 and the transfer roller 52. At this point, a bias voltage is applied to the transfer roller 52. The toner is transferred to the printing paper due to the difference in electric potential between the photoreceptor drum 54 and the transfer roller 52. The toner is transferred to the printing paper at a uniform density because a visible image having a uniform thickness is developed on the photoreceptor drum main body 54*a*. In this way, the printing density is uniformly maintained.

A desired image (text or drawing) is printed on the printing paper by means of each of the aforementioned processes.

The axis direction seal portion 156*a* shown in FIG. 7 is formed from polyethylene terepthalate (PET), and thus has a lower coefficient of friction than the rotation direction seal portion 156*b*. The present inventors discovered that when the developing roller 50 is rotated between each process described above, and the toner adheres to an area which is located upstream of the contact area 190, there is a tendency for the toner adhered to the axis direction seal portion 156*a* to move outward (rightward in FIG. 7). The arrow P in FIG. 7 shows the outward movement of the toner adhered to the axis direction seal portion 156*a*. In the present embodiment, the upstream end 150*d* of the side seal member 150 is located between the upstream end l90*b* and the downstream end 190*a* of the contract area 190. The side seal member 150 is not located upstream of the contact area 190. Thus, the toner that has moved in the direction of the arrow P will not reach the side seal member 150. The toner that has moved in the direction of arrow P is housed in the toner receiver 182. In addition, because a gap is provided between the axis direction seal portion 156*a* and the side seal member 150, it is difficult for the toner that has moved in the direction of the arrow P to move toward the side seal member 150. According to the present embodiment, the toner that has moved in the direction of the arrow P can be effectively prevented from entering between the side seal member 150 and the case main body 43*a*.

Although a gap is provided between the axis direction seal portion 156*a* and the side seal member 150, the outer surface 156*c* of the rotation direction seal portion 156*b* is in contact with the inner surface 150*e* of the side seal member 150. In this way, a seal is created between the axis direction seal member 156 and the side seal member 150. Toner can be prevented from leaking out from between the axis direction seal member 156 and the side seal member 150.

In the present embodiment, the axis direction seal member 156 is formed by the axis direction seal portion 156*a* and the rotation direction seal portion 156*b*. Because the rotation direction seal portion 156*b* is provided, it is difficult for toner on the right end or left end of the axis direction seal portion 156*a* to enter between the axis direction seal portion 156*a* and the case main body 43*a*. Because of this, the sealing effect can be further improved.

The sealing effect of the developer cartridge 43 of the present embodiment is extremely high. If this developer cartridge 43 is used, soiling of the printer 10 by leaked toner can be effectively prevented.

Specific examples of embodiments of the present invention are presented above, but these merely illustrate some possibilities of the invention and do not restrict the claims thereof. The technique set forth in the claims includes transformations and modifications to the specific examples set forth above.

For example, the side seal member 150 and the axis direction seal member 156 can be modified as follows.

(Variant 1)

Figure 8:
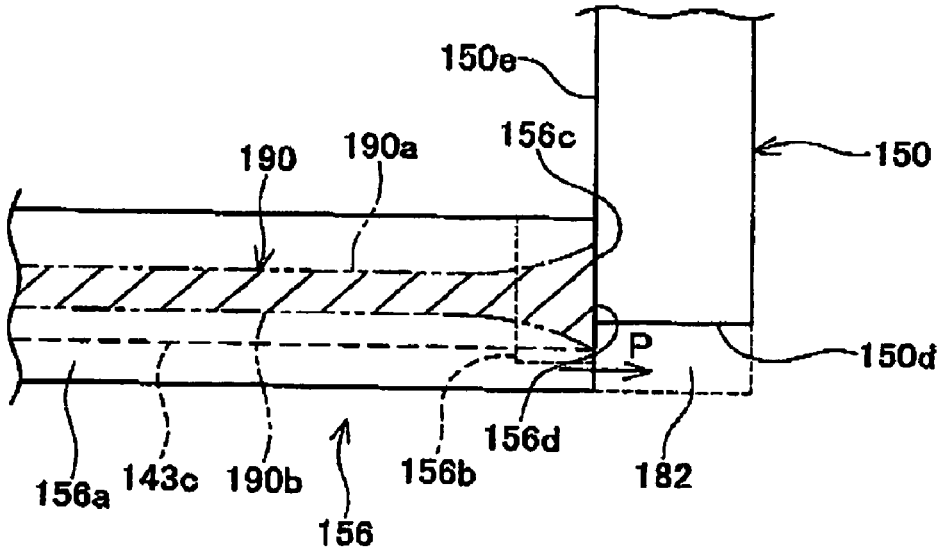
FIG. 8 shows a simplified front view of a side seal member and an axis direction seal member (Variant 1).

FIG. 8 shows a simplified front view of the side seal member 150 and the axis direction seal member 156 of the present modification. In this modification, the rotation direction seal portion 156*b* does not project outward (to the right in FIG. 8) more than the axis direction seal portion 156*a*. In this case, the outer surface 156*d* of the axis direction seal portion 156*a* is in contact with the inner surface 150*e* of the side seal member 150. In addition, the outer surface 156*c* of the rotation direction seal portion 156*b* is in contact with the inner surface 150*e* of the side seal member 150. In the present modification, the upstream end 150*d* of the side seal member 150 is positioned between the upstream end 190*b* and the downstream end 190*a* of the contract area 190.

With this configuration, the developer cartridge 43 having a highly effective seal can be achieved.

(Variant 2)

Figure 9:
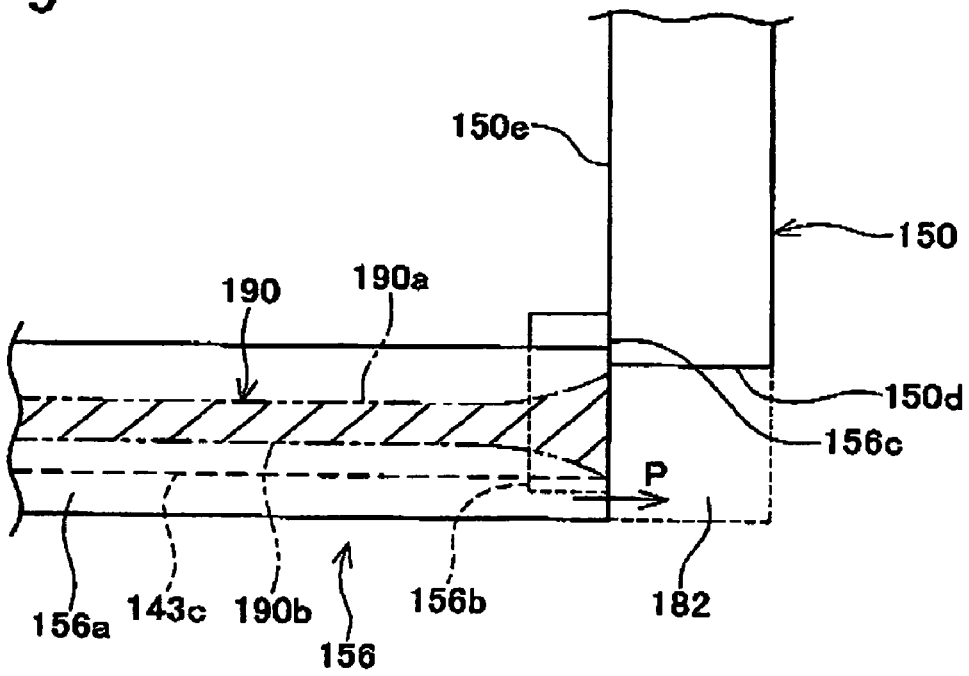
FIG. 9 shows a simplified front view of a side seal member and an axis direction seal member (Variant 2).

FIG. 9 shows a simplified front view of the side seal member 150 and the axis direction member 156 of the present modification. In this modification, the rotation direction seal portion 156*b* projects downstream (the upper side in FIG. 9) more than the axis direction seal portion 156*a*. The rotation direction seal portion 156*b* does not project outward (to the right in FIG. 9) from the axis direction seal portion 156*a*. The outer surface 156*c* of the rotation direction seal portion 156*b* is in contact with the inner surface 150*e* of the side seal member 150. In this modification, the upstream end 150*d* of the side seal member 150 is located downstream of the downstream end 190*a* of the contact area 190.

With this modification, a large space is formed between the area that is located upstream of the contact area 190 and the upstream end 150*d* of the side seal member 150. Thus, it is difficult for toner that has moved in the direction of the arrow P to reach the side seal member 150. According to the present modification, a larger toner receiver 182 can be provided.

(Variant 3)

Figure 10:
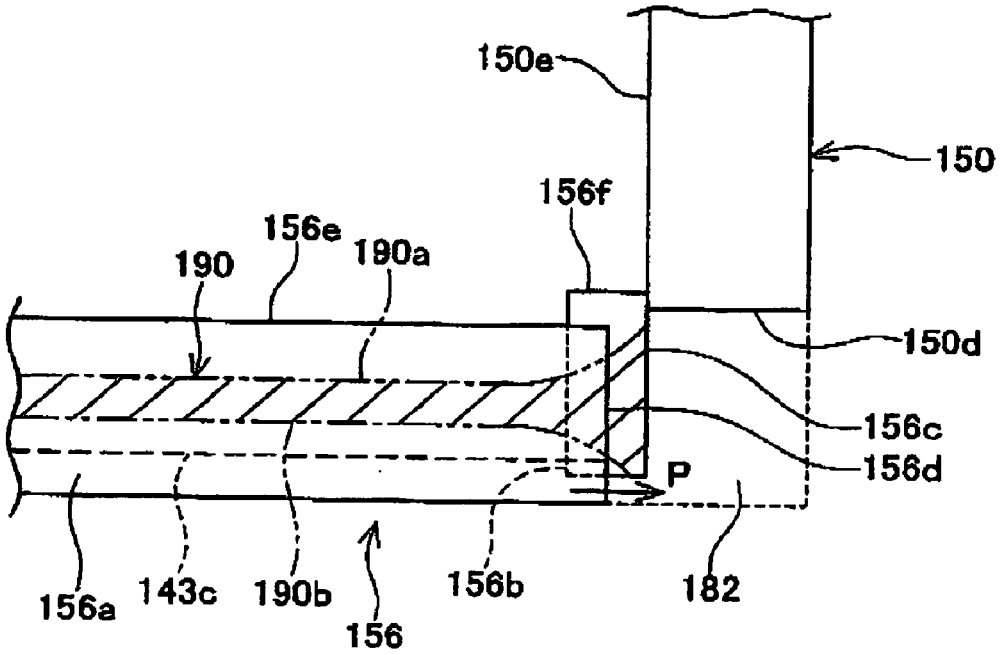
FIG. 10 shows a simplified front view of a side seal member and an axis direction seal member (Variant 3).

FIG. 10 shows a simplified front view of the side seal member 150 and the axis direction member 156 of the present modification. In this modification, the rotation direction seal portion 156*b* projects downstream (the upper side in FIG. 10) more than the axis direction seal portion 156*a*. In addition, the rotation direction seal portion 156*b* projects outward (to the right in FIG. 10) more than the axis direction seal portion 156*a*. The rotational direction seal 156*b* is in contact with the developing roller 50 at these projecting portions. The outer surface 156*c* of the rotation direction seal portion 156*b* is in contact with the inner surface 15O*e* of the side seal member 150. In this modification, the upstream end 150*d* of the side seal member 150 is located downstream of the downstream end 190*a* of the contact area 190. The upstream end 150*d* of the side seal member 150 is located between the downstream end 156*e* of the axis direction seal portion 156*a* and the downstream end 156*f* of the rotation direction seal portion 156*b*.

With this configuration, a large space can be formed between the area that is located upstream of the contact area 190 and the upstream end 150*d* of the side seal member 150. In addition, a large toner receiver 182 can be provided.

(Variant 4)

In the above embodiment, the rotation direction seal portion 156*b* is formed from felt. However, the rotation direction seal portion 156*b* may be formed from another material. For example, the rotation direction seal portion 156*b* may be formed from sponge.

In addition, the technical elements disclosed in the present specification or figures may be utilized separately or in various combinations and are not limited to the combination set forth in the claims at the time of filing of this application. Furthermore, the technique disclosed in the present specification or figures may be utilized to simultaneously realize a plurality of objects or to realize one of these objects.

What is claimed is:

1. A developing device, comprising:

a case main body comprising an opening;

a developing roller coupled with the case main body at a position facing the opening, the developing roller configured to rotate and support a developer housed in the case main body;

an axis direction seal member coupled with the case main body, the axis direction seal member extending along a rotation axis direction of the developing roller, the axis direction seal member sealing between the case main body and the developing roller by making contact with the developing roller; and a side seal member coupled with the case main body, the side seal member sealing between the case main body and an end portion of the developing roller in the rotation axis direction by making contact with the end portion of the developing roller, wherein the axis direction seal member and the side seal member make contact with one another such that there is no gap between the axis direction seal member and the side seal member in the rotation axis direction, and in a rotation direction of the developing roller, an upstream end of the side seal member is located downstream of an upstream end of a contact area between the axis direction seal member and the developing roller.

2. The developing device as in claim 1, wherein the axis direction seal member comprises a first member and a second member, the first member extends along the rotation axis direction and makes contact with the developing roller, and the second member is located between an end portion of the first member in the rotation axis direction and the case main body.

3. The developing device as in claim 2, wherein, in the rotation direction, the second member extends downstream beyond the first member, the second member and the side seal member make contact with one another such that there is no gap between the second member and the side seal member in the rotation axis direction, and in the rotation direction, the upstream end of the side seal member is located between a downstream end of the first member and a downstream end of the second member.

4. The developing device as in claim 2, wherein, the second member extends outward beyond the first member in the rotation axis direction, the second member and the side seal member make contact with one another such that there is no gap between the second member and the side seal member in the rotation axis direction, and a gap is arranged between the first member and the side seal member in the rotation axis direction.

5. The developing device as in claim 2, wherein, a coefficient of friction of the first member is smaller than a coefficient of friction of the second member.

6. The developing device as in claim 2, wherein the second member is formed from felt or sponge.

7. The developing device as in claim 1, wherein, in the rotation direction, the upstream end of the side seal member is located between the upstream end of the contact area and a downstream end of the axis direction seal member.

8. The developing device as in claim 7, wherein, in the rotation direction, the upstream end of the side seal member is located between the upstream end of the contact area and a downstream end of the contact area.

9. The developing device as in claim 1, wherein, in the rotation direction, the upstream end of the side seal member is located downstream of a downstream end of the contact area.

10. The developing device as in claim 9, wherein, in the rotation direction, the upstream end of the side seal member is located between the downstream end of the contact area and a downstream end of the axis direction seal member.

11. The developing device as in claim 1, wherein the case main body further comprises a developer receiver located adjacent to an end portion of the axis direction seal member in the rotation axis direction.

12. The developing device as in claim 1, wherein the developer is a non-magnetic mono-component polymerization toner.

13. The developing device as in claim 1, wherein the developing device is a developer cartridge that is detachably mounted on an image forming device that forms an image by utilizing the developer.

14. A process cartridge that is detachably mounted on an image forming device that forms an image by utilizing a developer, the process cartridge comprising:

a photoreceptor and the developing device as in claim 1, wherein the developer supported by the developing roller of the developing device is supplied to a surface of the photoreceptor.

15. An image forming device that forms an image on a recording medium by utilizing a developer, the image forming device comprising:

a photoreceptor and the developing device as in claim 1, wherein the developer supported by the developing roller of the developing device is supplied to a surface of the photoreceptor, and the developer supplied to the surface of the photoreceptor is transferred to the recording medium.

* * * * *